US007530121B2

(12) United States Patent
Snider

(10) Patent No.: US 7,530,121 B2
(45) Date of Patent: May 12, 2009

(54) PORTABLE DISPOSABLE URINATION CAPTURE DEVICE SYSTEM AND METHOD OF USING

(76) Inventor: Carolyn Snider, 196 Wynstone Ct., Xenia, OH (US) 45385

( * ) Notice: Subject to any disclaimer, the term of this patent is extended or adjusted under 35 U.S.C. 154(b) by 780 days.

(21) Appl. No.: 11/232,153

(22) Filed: Sep. 21, 2005

(65) Prior Publication Data

US 2007/0061951 A1 Mar. 22, 2007

(51) Int. Cl.
*A47K 11/00* (2006.01)

(52) U.S. Cl. ..... 4/144.2; 4/144.1

(58) Field of Classification Search ..... 4/144.1–144.4, 4/479, 484

See application file for complete search history.

(56) References Cited

U.S. PATENT DOCUMENTS 3,403,410 A * 10/1968 Benzel et al. ..... 4/144.2
3,421,506 A * 1/1969 Priebe et al. ..... 4/144.3 X
4,098,229 A 7/1978 Haynes et al.
4,285,077 A 8/1981 Braxton
4,360,932 A 11/1982 Yoshida
4,528,703 A 7/1985 Kraus
4,531,245 A 7/1985 Lowd et al.
4,537,153 A 8/1985 Vidal
4,626,249 A 12/1986 Hamey
4,681,573 A 7/1987 McGovern et al.
4,771,484 A 9/1988 Mozell
4,771,489 A 9/1988 Chen et al.
4,779,573 A 10/1988 Vidal
4,858,559 A 8/1989 Allen
4,998,298 A 3/1991 Mitchell
5,065,459 A 11/1991 Tjahaja et al.
5,091,998 A 3/1992 Witzke
5,116,139 A * 5/1992 Young et al. ..... 383/49
5,146,874 A 9/1992 Vidal
5,241,712 A 9/1993 Mahoney
5,243,712 A 9/1993 Cross
5,258,745 A 11/1993 Colling
5,282,283 A 2/1994 Atkin
5,370,637 A 12/1994 Brodeur
5,388,279 A 2/1995 Rasmussen
5,411,548 A 5/1995 Carman
5,416,469 A 5/1995 Colling
5,450,632 A 9/1995 Esswein et al.
5,551,097 A 9/1996 Short
5,557,263 A 9/1996 Fisher et al.
5,566,400 A 10/1996 Jonec
5,655,229 A 8/1997 Horn
D393,061 S 3/1998 Mandich et al.

(Continued)

*Primary Examiner*—Robert M Fetsuga
(74) *Attorney, Agent, or Firm*—Frost Brown Todd LLC

(57) ABSTRACT

A portable disposable urine capture device system, comprising a exterior container having an interior surface and an exterior surface, an interior collection mechanism wherein the interior collection mechanism includes an open end, a closed end forming a base, closed sides, and an integrally attached substantially conical elongate shaft with an upper opening and a lower opening, oriented inside the interior collection mechanism such that discharged urine is directed away from the body of a user, via said shaft configured to receive and direct the flow of the discharged urine into the base; an absorbent substance maintained in the base of the interior collection mechanism which binds with the discharged urine, a drape for shielding the user during the system use, one or more tissue wipes to absorb excess fluid from the user's body after use, and an antibacterial substance for hygienically cleansing the user's hands after use.

10 Claims, 6 Drawing Sheets

U.S. PATENT DOCUMENTS

| | | | |
|---|---|---|---|
| 5,722,096 | A | 3/1998 | Pfaeffle |
| 5,722,136 | A | 3/1998 | Jonec |
| 5,742,948 | A | 4/1998 | Cicio |
| 5,762,071 | A | 6/1998 | Newman et al. |
| 5,790,036 | A | 8/1998 | Fisher et al. |
| 5,822,804 | A | 10/1998 | Hauflaire |
| 5,852,830 | A | 12/1998 | Horn |
| 5,876,926 | A | 3/1999 | Beecham |
| 5,891,330 | A | 4/1999 | Morris |
| 5,903,932 | A | 5/1999 | Whitesel |
| 5,946,742 | A | 9/1999 | Parker |
| 6,065,726 | A | 5/2000 | Pfaeffle |
| 6,070,277 | A | 6/2000 | Thomas |
| 6,090,087 | A | 7/2000 | Tsukada et al. |
| 6,116,551 | A | 9/2000 | Pfaeffle |
| D437,051 | S | 1/2001 | Hernandez-Fumero |
| 6,256,800 | B1 | 7/2001 | Isbit |
| 6,401,263 | B2 | 6/2002 | Chang |
| 6,434,757 | B1 | 8/2002 | Filsouf |
| 6,449,782 | B1 | 9/2002 | Jones |
| D472,620 | S | 4/2003 | Phillips |
| 6,543,064 | B1 | 4/2003 | Prall et al. |
| 6,546,566 | B1 | 4/2003 | Geisel |
| 6,651,267 | B1 | 11/2003 | Utz |
| 6,684,414 | B1 | 2/2004 | Rehrig |
| 6,780,637 | B2 | 8/2004 | Olivier |
| D495,798 | S | 9/2004 | Gugliotta |

* cited by examiner

FIG. 7.A

PORTABLE DISPOSABLE URINATION CAPTURE DEVICE SYSTEM AND METHOD OF USING

FIELD OF THE INVENTION

The present invention relates, in general, to portable commodes and, more particularly pertains to a device for people who are away from a traditional restroom and find themselves with an urgency to urinate.

BACKGROUND OF THE INVENTION

Public restrooms and outdoor portable restrooms (i.e., "Port-a-Potties") are often unclean or unsanitary, but even more often, are just not available when a person needs to utilize the apparatus. Additionally, the percentage of the world population suffering from incontinence and a need to frequent the bathroom is steadily increasing. Small children, toddlers, and the elderly often have smaller bladders and less ability to prevent the need to use the restroom frequently. Because of these and many other factors, methods of creating and providing portable urinating apparatuses have been the subject of a great deal of research.

The use of portable urine capture devices is known in the prior art. Most specifically, portable commodes heretofore devised and utilized are known to consist basically of familiar, expected and obvious structural configurations, notwithstanding the plethora of designs encompassed by the prior art which have been developed for the fulfillment of countless objectives and requirements.

Unlike the prior art devices which fulfill their respective objectives and requirements, the present invention describes a disposable exterior container, with an interior collection mechanism, a privacy drape, tissue for wiping, and a hygienic wipe.

The present invention for disposable use as a portable restroom device is relevant to a variety of users in practically limitless situations; including, but not limited to, toddlers, children, young adults, adults and the elderly, at the mall, amusement parks, sporting events, boating, driving, camping, for marathon runners, at outdoor events, on airplanes, while on vacation, and the like. The present invention would be useful during a day of walking and sight seeing, or in response to the inevitable merchant signs stating "no public restrooms." The present invention could also be used as an aid in the formidable task of toilet training, especially in a non-home environment. The portable disposable urine capture device system of the present invention is a fully-contained, self disposable system for a decent, discrete, sanitary experience when restroom or toilet facilities are unavailable, unreachable, or undesirable. Additionally, this invention could also be used for persons experiencing motion sickness, such as on a boating vessel, an airplane, a train, or in an automobile.

An object of this invention is to provide a single design which can be made in different sizes (for youth or adults) and adapted for many uses. Another object is to provide a completely self contained portable urination captive device system which may be sealed and carried safely to a disposal site after use.

In these respects, the present invention substantially departs from the conventional concepts and designs of the prior art, and in doing so, provides a convenient, portable and disposable urine capture device system and method of using.

BRIEF SUMMARY OF THE INVENTION

In view of the disadvantages inherent in the known types of portable urinals or restroom devices now present in the prior art, the present invention provides a new portable disposable urine capture device system, wherein the same can be utilized in situations when restroom or toilet facilities are unavailable, unreachable or undesirable.

To attain this, the urine capture device system of the present invention is portable and disposable, and generally comprises a collapsible, pliable outer container or bag, an interior collection mechanism that directs the flow of fluid into the base of the system, absorbent material in the base of the system to bind with the fluid, a privacy drape, (also known as a "teepee"), tissue wipes for cleansing, and an antibacterial wipe or dollop of antibacterial gel for general hygiene use after using the system.

Several embodiments of the present invention provide a portable disposable urine capture device system that allows the user to relieve themselves at a time and place where the use of a traditional restroom device is not available or desired, and the user can maintain privacy, and finish the use in a hygienic manner.

In one embodiment, a portable disposable urine capture device system comprises an exterior container having an interior and an exterior surface, and an operable closure mechanism; an interior collection mechanism comprising an open end, a closed end forming a base, closed sides, and an integrally attached substantially conical elongate shaft with an upper opening and a lower opening, oriented inside the interior collection mechanism such that discharged urine is directed away from the body of a user, via the shaft configured to receive and direct the flow of the discharged urine into the base; an absorbent substance maintained in the base of the interior collection mechanism which binds with the discharged urine; a drape for shielding the user during system use; one or more tissue wipes operable to absorb excess fluid from the user's body after use, and an antibacterial substance for hygienically cleansing the user's hands after use. In addition, the tissue wipes may be infused with germicide and/or deodorizing compositions to impart a freshening to the area being wiped. The interior collection mechanism and drape are contained within the exterior container, and the one or more tissue wipes and the antibacterial substance are optionally contained inside the exterior container or are removably attached to the exterior surface of the exterior container.

In another embodiment, a method for using a urine capture device system comprises removing the interior collection mechanism from the exterior container, where the interior collection mechanism is operable to receive and direct the flow of discharged urine, and comprises an open end, a closed end forming a base, closed sides, and, a shaft configured to receive and direct the flow of the discharged urine into the base, an integrally attached substantially conical elongate shaft with an upper opening and a lower opening, oriented inside the interior collection mechanism such that discharged urine is directed away from the body of a user, and an absorbent substance located in the base to bind the discharged urine; removing the privacy drape and orienting it so as to shield the user's use of the collection mechanism from public view; removing the one or more tissue wipes operable to absorb excess fluid from the user's body after use; and removing the antibacterial substance for hygienically cleansing the user's hands after use.

More embodiments will be described below. Other embodiments will be apparent to those of ordinary skill in the art.

BRIEF DESCRIPTION OF THE FIGURES

The accompanying drawings, which are incorporated in and constitute a part of this specification, illustrate versions of the invention, and, together with the general description of the invention given above, and the detailed description of the versions given below, serve to explain the principles of the present invention.

In order that the invention may be more readily understood, particular embodiments will now be described with reference to the accompanying drawings wherein:

FIGS. 7A and 7B are views of the tissue wipe pouch and the antibacterial substance pouch of the present invention.

These figures are intended to be exemplary of the present invention, and not limiting thereof. In these figures, common numbering refers to the same element in each figure.

DETAILED DESCRIPTION OF THE INVENTION

It will be appreciated that for convenience and clarity, spatial terms such as "right", "left", "top", "bottom", "vertical" and "horizontal" are used herein with respect to the drawings. However, given the situation, the present invention may be used in many orientations and positions, and these terms are not intended to be limiting and absolute.

Figure 1:
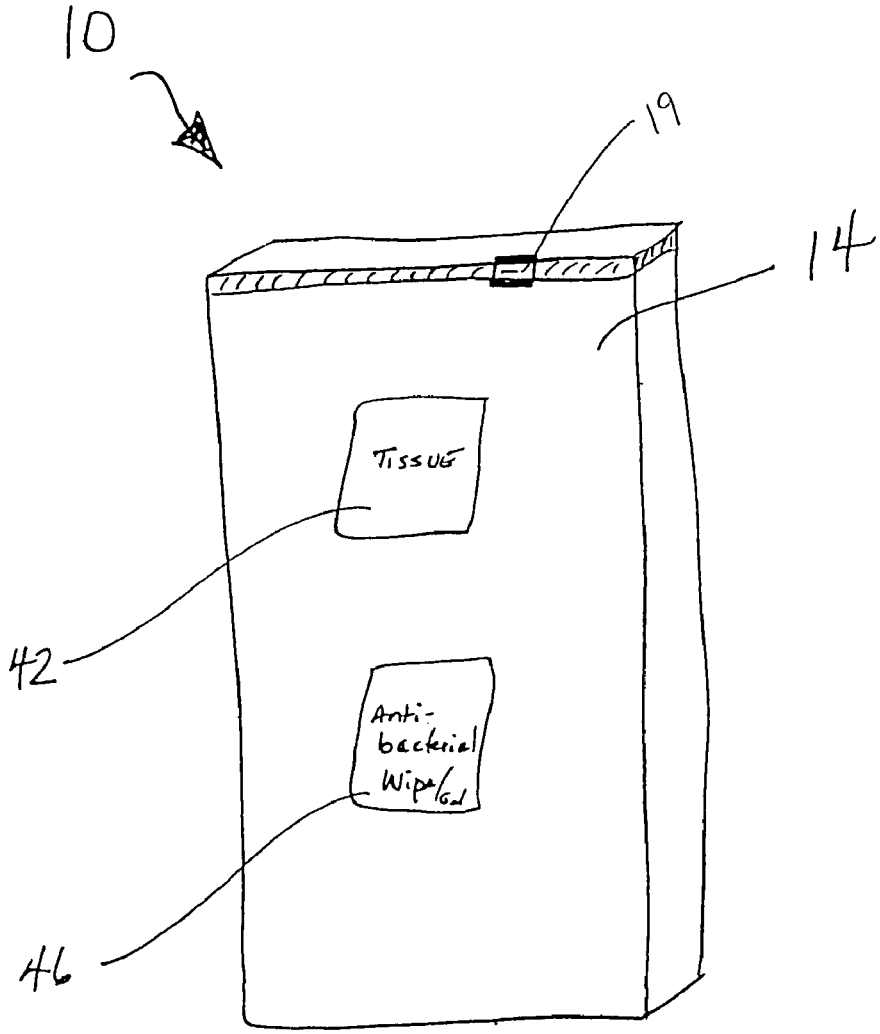
FIG. 1 is an isometric view showing generally the present invention.

Turning to those drawings, wherein like numerals denote like components throughout the several views, FIG. 1 generally depicts a portable disposable urine capture device system 10 that is comprised of an exterior container 14, an interior collection mechanism (not shown), a privacy drape (not shown), one or more tissue wipe pouches 42 and an antibacterial substance pouch 48.

The exterior container 14 may be made from a thermoplastic synthetic resin film, for example, polyethylene, but may be made from any suitable material, including paper or cloth for example, for convenient, reliable storage in a purse or pocket. Further, the container 14 is made of material inexpensively appropriate for discarding after use, as would be appreciated by one skilled in the art. The exterior container 14 with its interior surface and exterior surface, further has an operable closure mechanism 19 for access to the system's 10 components from the container 14. The color options of the exterior container 14 are limitless, but may optionally be opaque for discreteness and modesty. The exterior container 14 may also be used for placement of advertising or logos.

Figure 2:
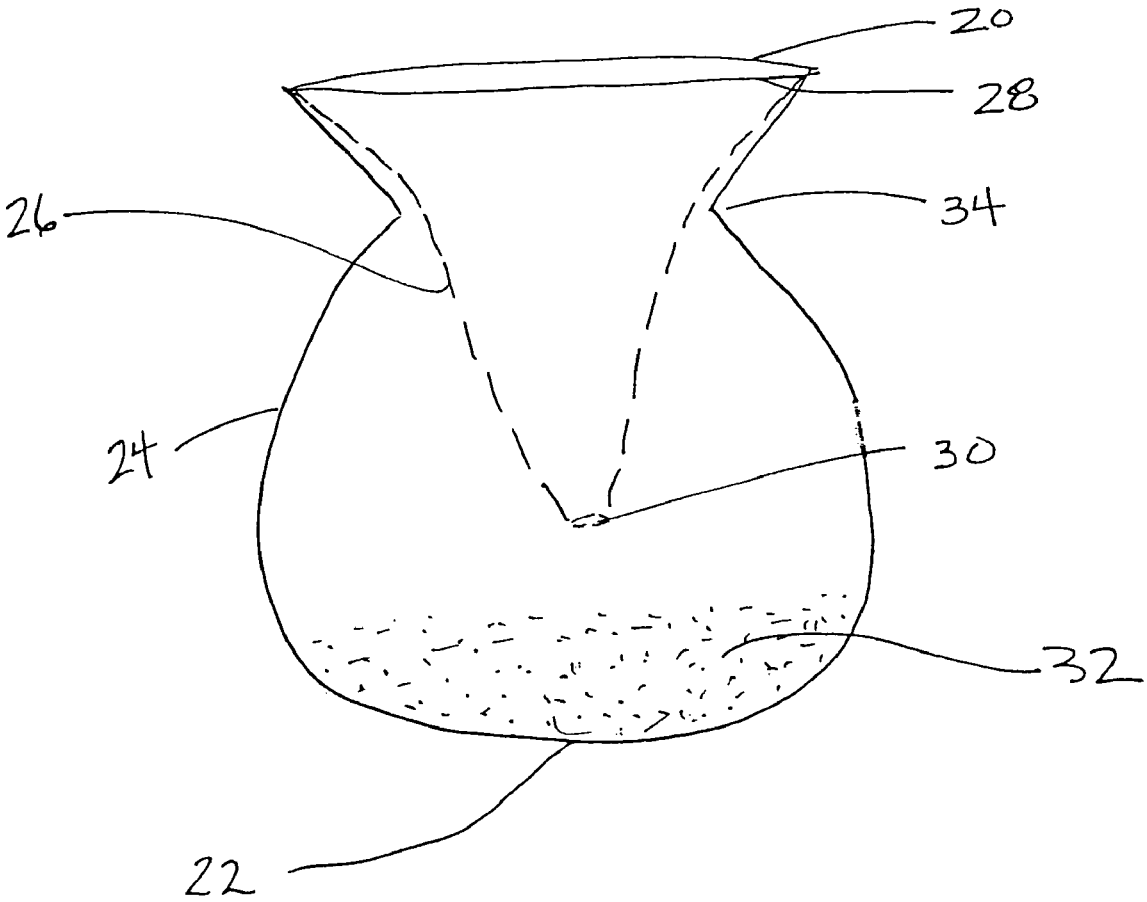
FIG. 2 is a view of the interior collection mechanism in a ready-to-use position.

The interior collection mechanism 16, as shown in FIG. 2, includes an open end 20, a closed end forming a base 22, closed sides 24 and an integrally attached substantially conical elongate shaft 26. The v-shaped shaft 26 has a substantially oval upper opening 28 (substantially the same as the open end 20), and a lower opening 30. The upper opening 28 has a longitudinal dimension being aligned with a longitudinal dimension of the lower opening, as illustrated in FIG. 2. The elongate shaft 26 is configured to receive and direct the flow of discharged fluids into the base 22 of the interior collection mechanism 16. An absorbent substance 32 is maintained in the base 22 of the interior collection mechanism 16 for binding the discharged urine, creating a mixture the consistency of wet sand. The absorbent substance 32 may be a super absorbent powder or gel, or silicate-based material (like amorphous alumina silicate), or any other combination of non-toxic, inert minerals appropriate for binding with the discharged fluids entering the interior collection mechanism 16, as would be apparent to those of ordinary skill in the art.

The outward shape of the interior collection mechanism 16 may be rectangular, cylindrical, triangular, or any of numerous other appropriate shapes. One embodiment of the outward shape of the mechanism 16 provides a wide open end 20, a narrower neck portion 34 immediately below the open end 20, transitioning back to wider closed sides 24 and base 22. The neck portion 34, seen again in FIG. 2, aids in holding the interior collection mechanism 16 during use. In one embodiment, the overall outer dimensions of the interior collection mechanism 16 are approximately 6 inches by 7 inches, but may be of numerous other shapes and sizes, appropriate for an adult or children's use.

Figure 3:
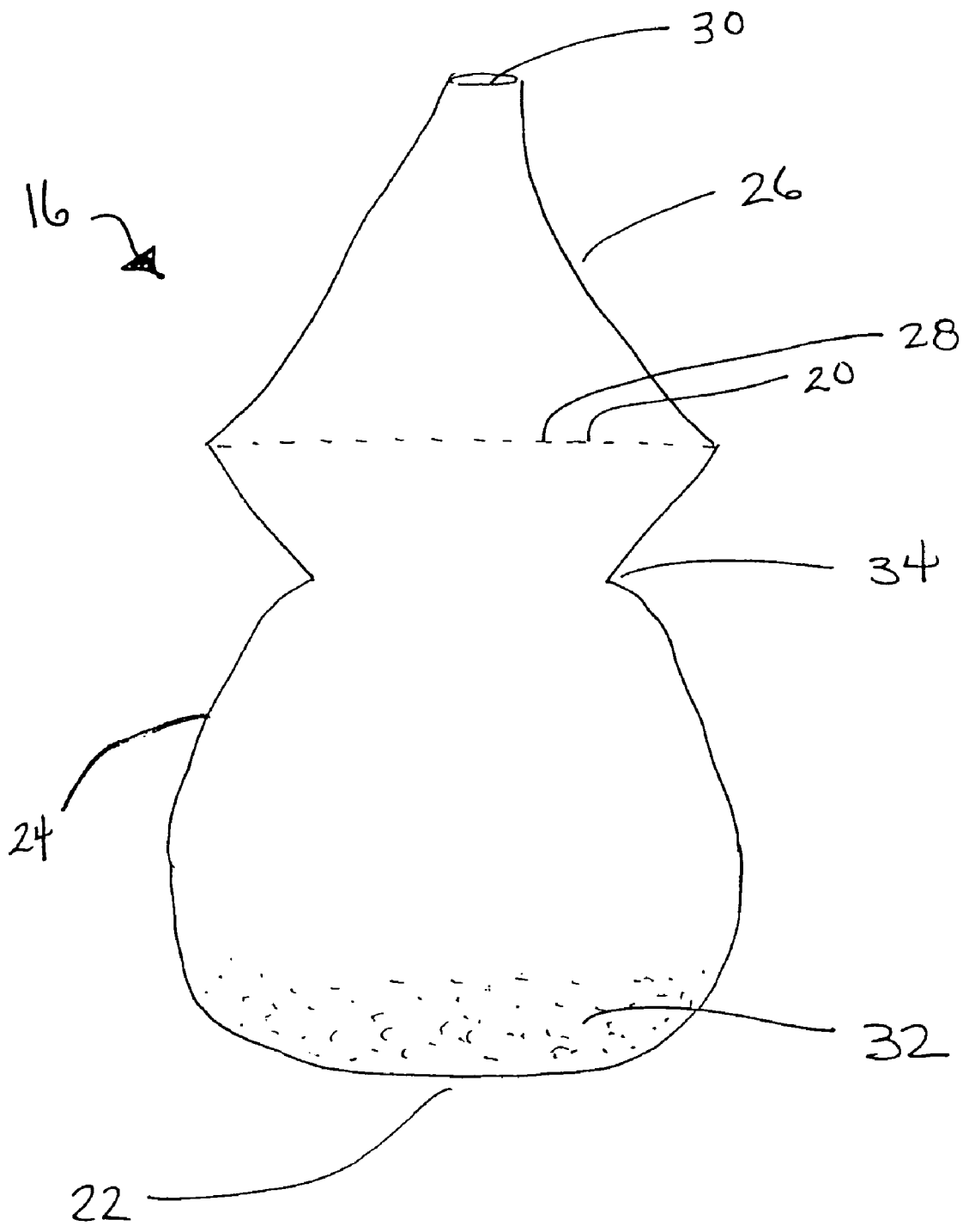
FIG. 3 is a side view of the interior collection mechanism showing the integrally attached substantially conical elongate shaft portion "outside" of the mechanism.

FIG. 3 illustrates the integrally attached substantially conical elongate shaft 26 in an inverted position, resting outside of the interior collection mechanism 16. In this example, FIG. 3 illustrates the shaft's upper opening 28 substantially the same as the interior collection mechanism's open end 20. Here, the shaft 26 is made of the same material as the mechanism 16 (although that is not required). However, it will be appreciated that the shaft 26, including components thereof, may have any other properties, including but not limited to malleability, water absorption or resilience, and other properties, or combinations thereof.

Figure 4:
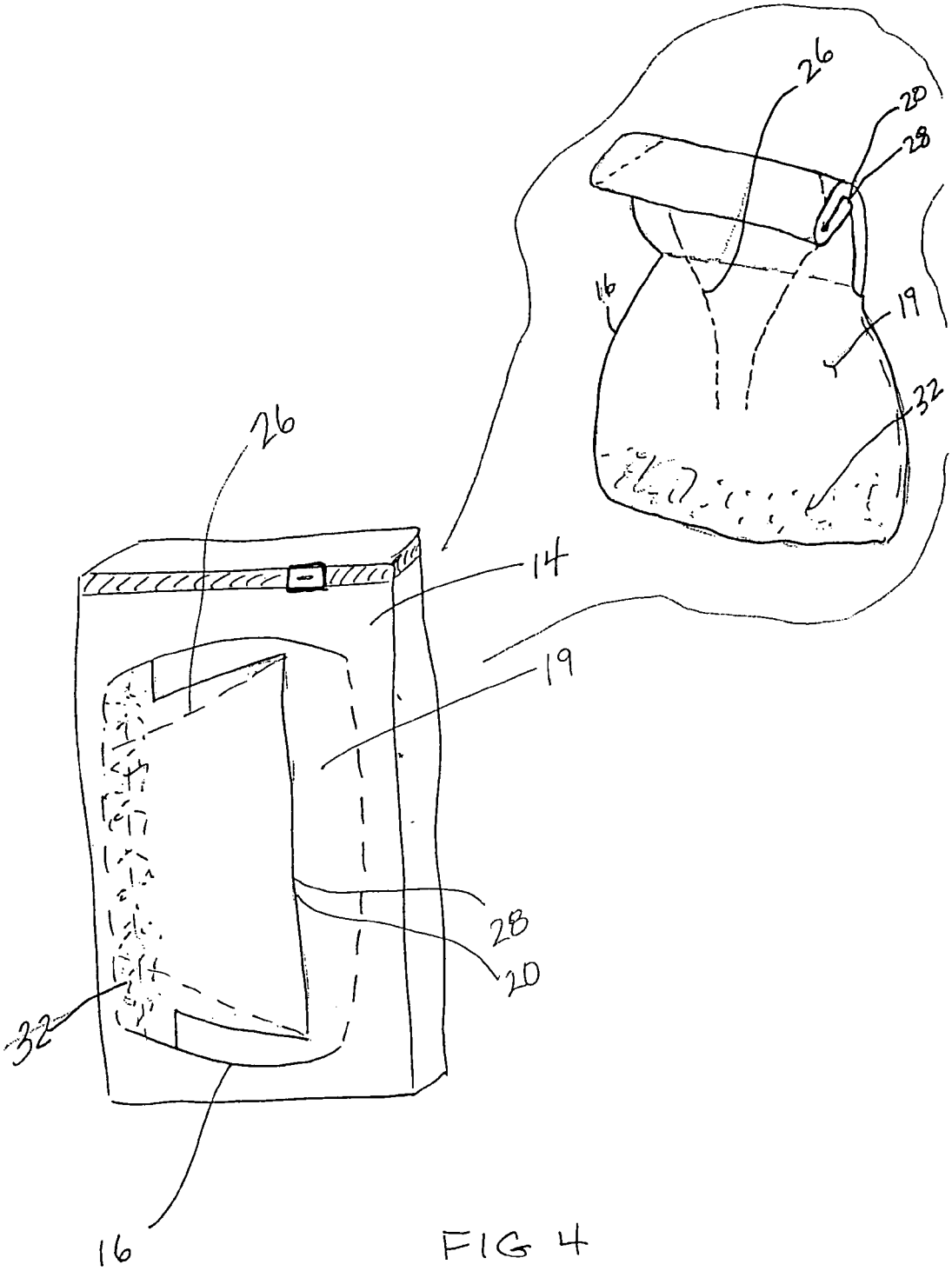
FIG. 4 is an exploded view showing generally the interior collection mechanism collapsed, folded and stored within the system's exterior container.

FIG. 4 illustrates one way in which the interior shelf mechanism 16 may be folded longitudinally upon itself from its open end 20 to bring a portion of the exterior surface 19 of the interior collection mechanism 16 into contact with the open end 20, essentially providing a virtual seal to prevent escape of the powdered silica-based substance 32 until use. In this configuration, when placed inside the exterior container 14, the portable disposable urine capture device system 10 can be contained to fit conveniently and discreetly in a pocket, glove compartment, purse, tote bag, etc.

Figure 5:
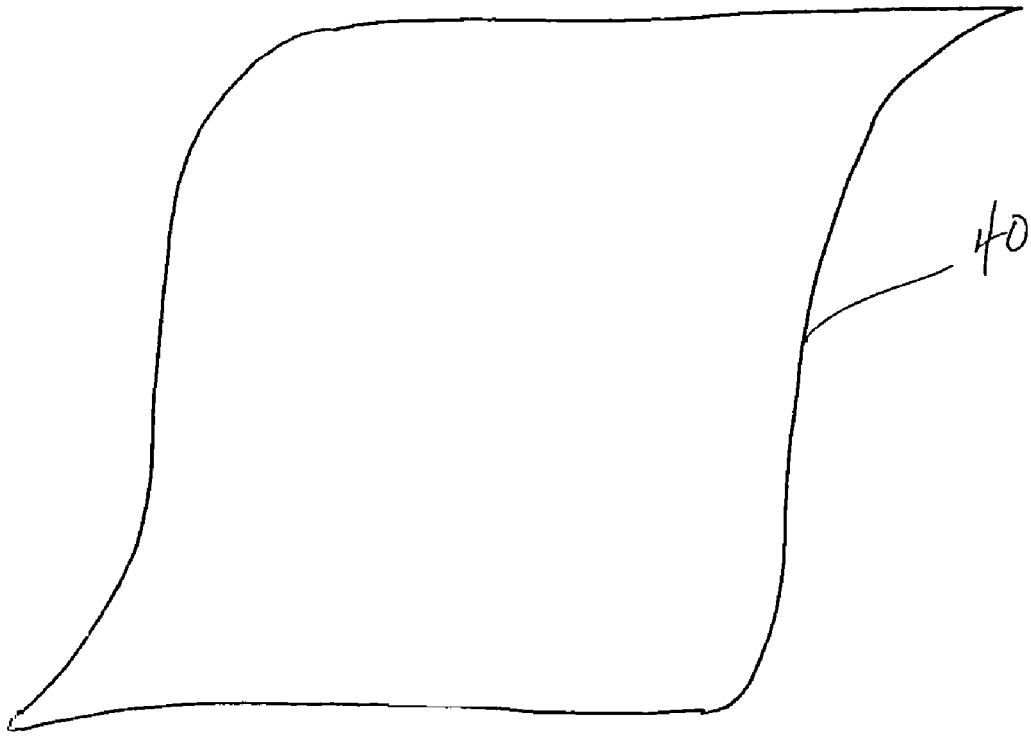
FIG. 5 is a perspective view of the privacy drape of the present invention.

The privacy drape 40, of FIG. 5 may be made of Mylar sheeting or any other lightweight material suitable for shielding a user from the public's eyes. The drape may be waterproof and may optionally include a closure device to aid in use, including but not limited to, snaps, ties, zipper or hook and loop fasteners such as VELCRO, etc. By way of example only, drape 40, may have a maximum outer dimension of approximately 40 inches by 50 inches. Of course, any other dimensions may be used, including the use of a smaller drape for a children's sized system.

Figure 7B:
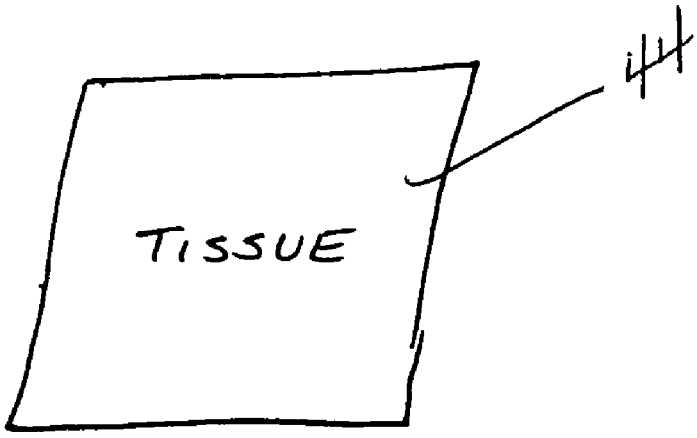
Figure 7B:
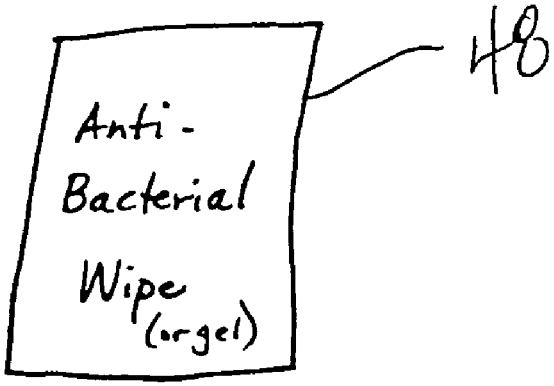

Turning now to FIGS. 7A and 7B, one or more tissue wipes (not shown) are provided as components of the system 10, for absorbing excess fluid from the user's body after use. The one or more tissue wipes may be conveniently contained in sealed pouches 44 and stored inside the exterior container until use. Additionally, an antibacterial substance (a wipe or a small amount of antibacterial gel) may be sealed in a separate pouch 48 for the express purpose of sanitarily wiping one's hands after using the system. The antibacterial pouch may also be conveniently stored inside the exterior container until use.

In one embodiment, both the one or more tissue wipe pouches 44 and the antibacterial wipe pouch 48 are removably attached to the exterior surface of the exterior container 14 with a rubberized glue (not shown) as would be understood by one skilled in the art.

Figure 6:
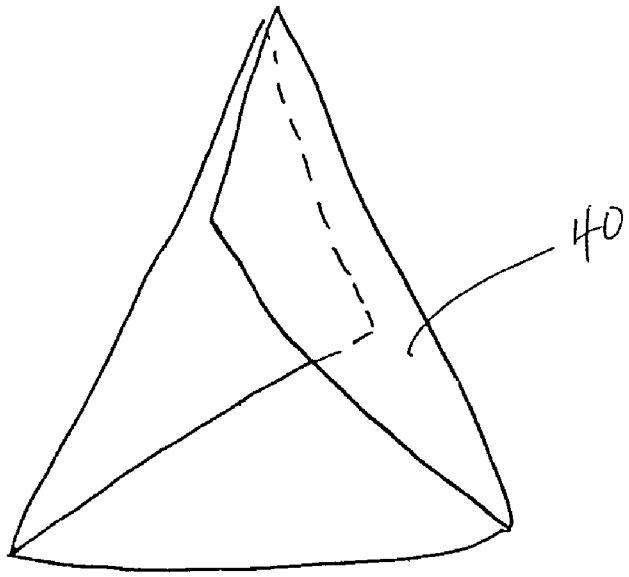
FIG. 6 is a perspective view of the privacy drape of the present invention oriented in a reverse conical ("teepee") configuration.

When use of the capture device system 10 is desired, the methodology is appropriate and is in conjunction with providing a convenient, portable and disposable urine capture device system. First, the interior collection mechanism 16 and the privacy drape 40 are removed from the exterior container 14. The privacy cape 40 is optionally oriented around the body of a user, or oriented into a reverse conical "teepee" shape for shielding a toddler or child, as seen in FIG. 6. Pressure is then applied with the fingers and thumb of one hand to the bottle neck portion 34 of the interior collection mechanism 16, causing the open end 20 to expand ovally open to receive the discharged fluid or urine. After use, the user may remove one or more tissue wipes 42 to absorb excess fluid from the user's body. All components (except the antibacterial pouch) of the portable disposable urine capture device system may then be placed back into the exterior container 14 and disposed of in an appropriate waste receptacle. Finally, the user may remove any bacteria by using the antibacterial substance (a wipe or gel, for example) 46 to hygienically clean his or her hands.

The foregoing is considered as illustrative only of the principles of the invention. While a specific embodiment of the invention has been shown and described, it will be obvious to those skilled in the art that various changes and modifications may be made therein, without departing from the scope, spirit and intent of the invention as set forth in the appended claims.

With respect to the above description then, it is to be realized that the optimum dimensional relationship for the parts of the invention, to include variations in size, materials, form, shape, function, and manner of operation, assembly and use, are deemed readily apparent and obvious to one skilled in the art, and all equivalent relationships to those illustrated in the drawings and described in the specification are intended to be encompassed by the present invention.

Having shown and described various embodiments and concepts of the invention, further adaptations of the methods and systems described herein can be accomplished by appropriate modifications by one of ordinary skill in the art without departing from the scope of the invention. Several of such potential alternatives, modifications, and variations have been mentioned, and others will be apparent to those skilled in the art in light of the foregoing teachings. Accordingly, the invention is intended to embrace all such alternatives, modifications and variations as may fall within the spirit and scope of the appended claims and is understood not to be limited to the details of structure and operation shown and described in the specification and drawings. Additional advantages may readily appear to those skilled in the art.

Therefore, it is not desired to limit the invention to the exact construction and operation shown and described. Accordingly, all such suitable changes or modifications in structure or operation which may be resorted to are intended to fall within the scope of the claimed invention.

What is claimed is:

1. A portable disposable urine capture device system, comprising:

(a) an exterior container having an interior surface and an exterior surface, and an operable closure mechanism;

(b) an interior collection mechanism comprising an open end, a closed end forming a base, closed sides, and an integrally attached substantially conical elongate shaft with an upper opening and a lower opening, oriented inside said interior collection mechanism such that discharged urine is directed away from the body of a user, via said shaft configured to receive and direct the flow of the discharged urine into said base; an absorbent substance maintained in said base of said interior collection mechanism which binds with the discharged urine;

(c) a drape for shielding the user during said system use;

(d) one or more tissue wipes, wherein each of the one or more tissue wipes is operable to absorb excess fluid from the user's body after use; and (e) an antibacterial substance for hygienically cleansing the user's hands after use, wherein said interior collection mechanism and drape are contained within said exterior container; and said one or more tissue wipes and said antibacterial substance are optionally contained inside said exterior container or removably attached to said exterior surface of said exterior container.

2. The portable disposable urine capture device system of claim 1, wherein said substantially conical elongate shaft is configured such that said open end and upper opening are substantially the same, and said shaft and said interior collection mechanism are made of identical material.

3. The portable disposable urination capture device system of claim 1, wherein said interior collection device further includes a narrower neck portion below said open end.

4. The portable disposable urination capture device system of claim 1, wherein said one or more tissue wipe pouches and said antibacterial wipe pouches are removably attached to the exterior surface of said exterior container.

5. The portable disposable urination capture device system of claim 1, wherein the antibacterial substance is a wipe cloth.

6. The portable disposable urination capture device system of claim 1, wherein the antibacterial substance is a gel.

7. A method for using a portable, disposable urine capture device system, the method comprising:

(a) removing said interior collection mechanism from said exterior container, wherein the mechanism is operable to receive and direct the flow of discharged urine, and comprises:

(i) an open end, a closed end forming a base, closed sides, and, (ii) a shaft configured to receive and direct the flow of the discharged urine into said base, an integrally attached substantially conical elongate shaft with an upper opening and a lower opening, oriented inside said interior collection mechanism such that discharged urine is directed away from the body of a user, and (iii) an absorbent substance located in said base, wherein said substance is operable to bind the discharged urine;

(b) removing said privacy drape;

(c) orienting said privacy drape so as to shield the user's use of the collection mechanism from public view;

(d) removing the one or more tissue wipes operable to absorb excess fluid from the user's body after use, from the exterior container; and (e) removing the antibacterial substance for hygienically cleansing the user's hands after use from the exterior container.

8. The method for using a portable, disposable, urine capture device system of claim 7, the method further comprising applying pressure to the neck portion of said interior collection mechanism, causing the open end to expand ovally open to receive the discharged fluid or urine.

9. The method for using a portable, disposable, urine capture device system of claim 7, the method further comprising placing all of the used system components into said exterior container.

10. The method for using a portable, disposable, urine capture device system of claim 7, the method further comprising disposing of the used system into an appropriate waste receptacle.

* * * * *